United States Patent [19]

Singer

[11] Patent Number: 4,631,763

[45] Date of Patent: Dec. 30, 1986

[54] RETRACTABLE BED WITH A PIVOTED SCREW DRIVE

[76] Inventor: Morris Singer, 3712 W. 96th St., Overland Park, Kans. 66206

[21] Appl. No.: 701,744

[22] Filed: Feb. 14, 1985

Related U.S. Application Data

[63] Continuation-in-part of Ser. No. 171,332, Jul. 23, 1980, Pat. No. 4,586,206.

[51] Int. Cl.[4] ..... A47C 19/06

[52] U.S. Cl. ..... 5/149; 5/158; 5/159 R

[58] Field of Search ..... 5/133, 146, 147, 149, 5/158, 159 R

[56] References Cited

U.S. PATENT DOCUMENTS

| | | | |
|---|---|---|---|
| 438,132 | 10/1890 | Anderson et al. . | |
| 1,004,104 | 9/1911 | Taylor . | |
| 1,542,766 | 6/1925 | Hall | 5/133 |
| 2,484,377 | 10/1949 | Eramo et al. . | |
| 2,628,371 | 2/1953 | Null . | |
| 2,683,883 | 7/1954 | Hirst | 5/159 R |
| 3,517,397 | 6/1970 | Moore . | |
| 4,449,263 | 5/1984 | Wilson et al. . | |

FOREIGN PATENT DOCUMENTS

| | | | |
|---|---|---|---|
| 2210161 | 3/1972 | Fed. Rep. of Germany | 5/159 R |
| 605520 | 5/1926 | France | 5/158 |
| 261176 | 11/1928 | Italy | 5/147 |

*Primary Examiner*—Gary L. Smith
*Assistant Examiner*—Michael F. Trettel
*Attorney, Agent, or Firm*—Litman, Day & McMahon

[57] ABSTRACT

A retractable bed includes a self-standing enclosure frame having tracks with curved segments at opposite ends of the enclosure. A mattress support frame formed of interconnected hinged sections has rollers which engage the tracks such that the mattress frame slides between a retracted position within the enclosure and a sleeping position extending from the enclosure. The mattress frame is oriented to move sideways into and out of the enclosure. A motor bracket is pivotally connected to the enclosure frame, has a motor mounted thereon, and has an elongated threaded shaft engaged with the motor. A nut arm is pivotally connected to the mattress frame, and a nut on a free end of the arm is threaded onto the shaft. Rotation of the shaft moves the mattress frame along the tracks for extension and retraction. Pivoting of the drive assembly accommodates movement of the mattress frame around the curved segments of the tracks.

15 Claims, 7 Drawing Figures

Fig. 1.
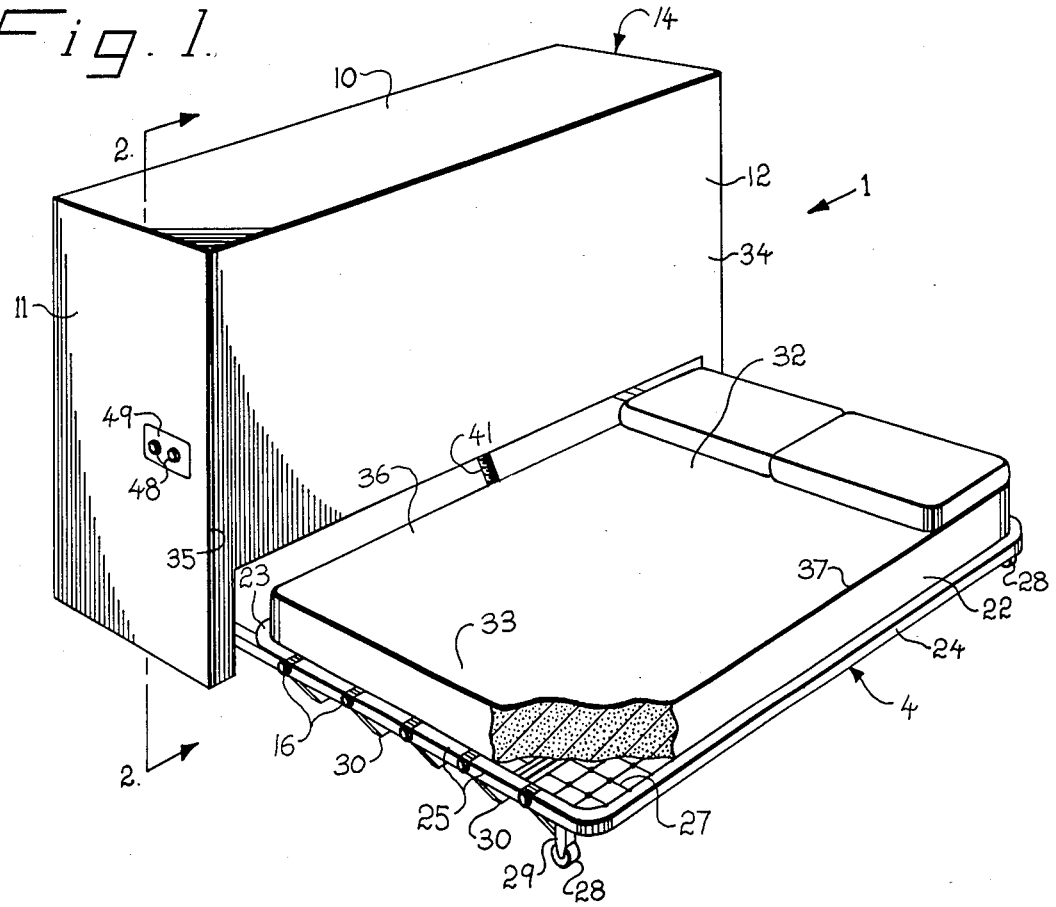
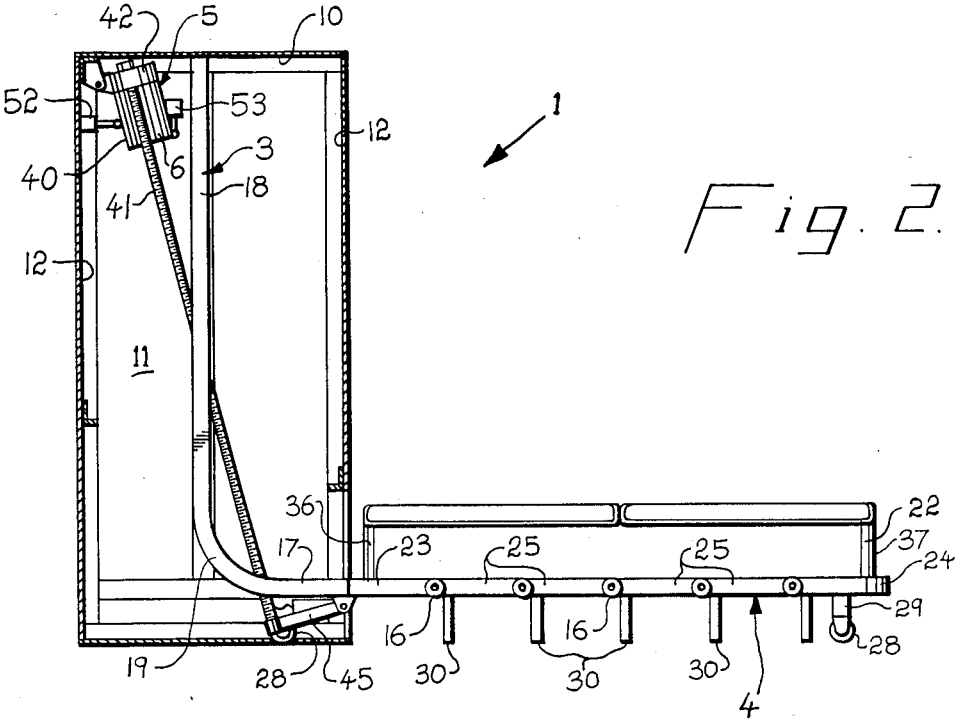
Fig. 2.

Fig. 6.
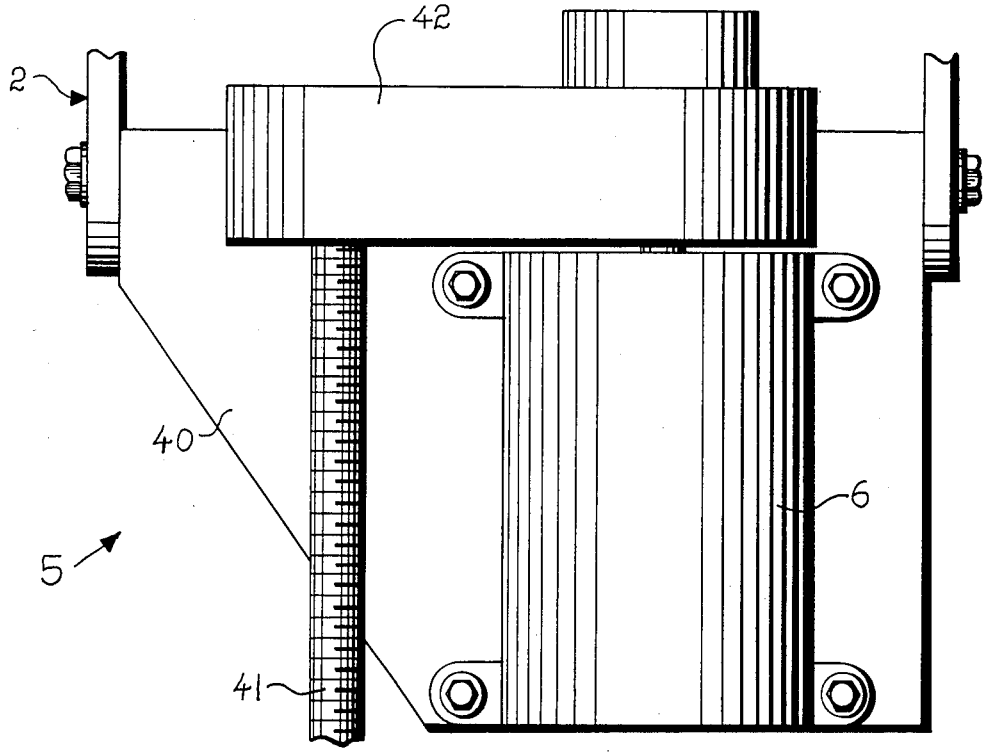
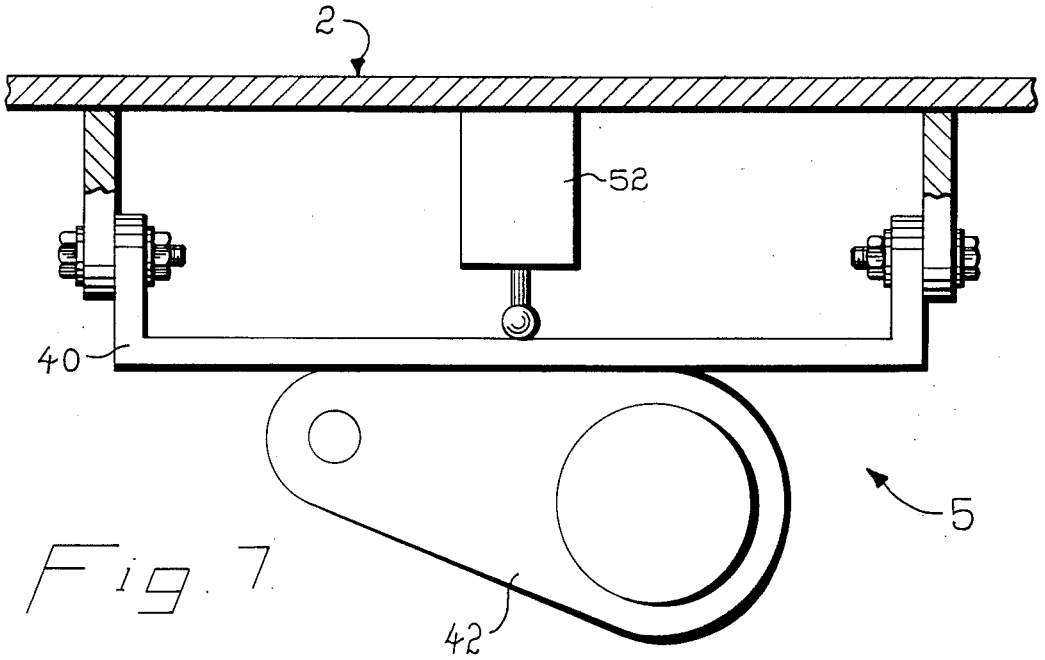
Fig. 7.

RETRACTABLE BED WITH A PIVOTED SCREW DRIVE

CROSS-REFERENCE TO RELATED APPLICATION

The present invention is a continuation-in-part of application Ser. No. 171,332 for CONVERTIBLE SOFA-BED ARRANGEMENT filed July 23, 1980, now U.S. Pat. No. 4,586,206, issued May 6, 1986.

FIELD OF THE INVENTION

The present invention relates to temporary beds and, more particularly, to a retractable bed driven by a pivoted motor assembly including a screw threaded shaft.

BACKGROUND OF THE INVENTION

Mechanically deployable beds have been in existence for many years for temporary sleeping accommodations and for regular use in limited space. In many cases such beds take the form of convertible sofas or chairs which have a mattress folded therein or in which the cushions can be folded out to form a mattress. Other types of folding beds include well known rollaway beds which can be folded up and rolled to a place of storage and Murphy-type beds which fold into closet-like enclosures. Still other types of beds combine various types of furniture with a bed. For example, one known unit includes a chest of drawers, a mirror, a couch, and a trundle bed-type slidable mattress frame.

In an effort to facilitate the conversion of combination beds and the deployment of folding beds, attempts have been made to employ motors such as electric motors. In general, there have been problems in devising motorized convertible or deployable beds of practical sizes and weights and at an acceptable price. Convertible and deployable beds tend to be large and heavy, and the addition of a motor and motion transfer elements add to the weight. In addition, there have been reliability problems, particularly where cables are used to transfer motion from the motor to the movable bed portions due to the complexity of the mechanism and the tendency of cables to stretch.

In one known bed arrangement, (U.S. Pat. No. 4,449,263 to Wilson, et al.), the deployment mechanism is a pivoted jackscrew device such as are used on adjustable type hospital beds. The screw device is connected to a lever at an extreme end of the rigid mattress frame. Because of a leverage disadvantage, at least one counterbalancing mechanism is needed to help raise the frame for storage. Since the frame is pivoted from the end, the deployment mechanism must be extra rugged to prevent failure thereof which could be a very hazardous situation.

In another known arrangement (U.S. Pat. No. 3,417,397 to Moore), the deployment mechanism includes a fixed position motor and elongated screw shaft assembly and a nut member which is pivotally connected to the mattress frame. The rigid mattress frame is lifted by a proximal end while the distal end follows on casters. Both the Moore and Wilson et al. devices are relatively complex mechanisms which increases the cost of their manufacture and installation.

In many deployable bed arrangements, the mattress frame is stored and extended in a lengthwise direction. Such lengthwise deployment increases the intrusion of the mattress frame into the room in which it is situated thus limiting the flexibility of furniture placement near the bed.

SUMMARY OF THE INVENTION

The retractable bed according to the present invention includes an enclosure frame which can be either selfstanding or incorporated in a recess in a building wall. The mattress frame is slidable on tracks within the enclosure which include short horizontal segments and long vertical segments connected by curved segments. The motor assembly includes a motor bracket pivoted on the enclosure frame and a long screw threaded shaft which cooperates with a nut on an arm pivotally connected to the mattress frame. The curved segments of the tracks and the pivotability of the motor assembly allow the motor assembly to follow the mattress frame around the curved track segments. The mattress frame is oriented to move sideways into and out of the enclosure whereby the intrusion thereof into the room and the height of the enclosure are minimized.

OBJECTS OF THE INVENTION

The principal objects of the present invention are: to provide an improved retractable bed structure; to provide such a structure for extra or temporary sleeping accommodations when needed and for the storage of such a bed when not needed; to provide such a structure including an upstanding cabinet type of enclosure and a selectively deployable mattress frame which stores in the enclosure; to provide such a structure wherein the enclosure may be in the form of a recess in a building wall or partition such that the bed is a built-in type of structure; to provide such a structure wherein the mattress frame has rollers thereon engaged with tracks which extend into the enclosure; to provide such a structure wherein the mattress is formed of hinged together sections and the tracks have straight segments connected by curved segments; to provide such a structure wherein the mattress frame is supported on a floor in the extended position of the bed; to provide such a structure wherein the extension and retraction of the mattress frame is accomplished by the operation of a motor; to provide such a structure wherein the motor is mounted on a pivotable bracket, an elongated screw shaft is mounted on the bracket and engaged with the motor, and a drive link or arm has a nut thereof engaged with the screw shaft and pivotally connected to the mattress frame whereby the motor assembly pivots to follow the motions of the mattress frame as the frame is extended and retracted; to provide such a structure wherein the mattress frame is oriented such that it is moved laterally of the sleeping orientation of the frame to minimize the intrusion of the frame into the room in which it is installed; and to provide such a retractable bed structure which is economical to manufacture, durable and convenient in operation, and which is particularly well adapted for its intended purpose.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 1 is a perspective view of a retractable bed according to the present invention.

FIG. 2 is a sectional elevational view of the bed taken on line 2—2 of FIG. 1 and illustrates details of the bed in an extended or sleeping position.

FIG. 6 is an enlarged side elevational view of the pivoted motor assembly of the bed.

FIG. 7 is an enlarged plan view of the motor assembly.

DETAILED DESCRIPTION OF THE PREFERRED EMBODIMENT

Figure 3:
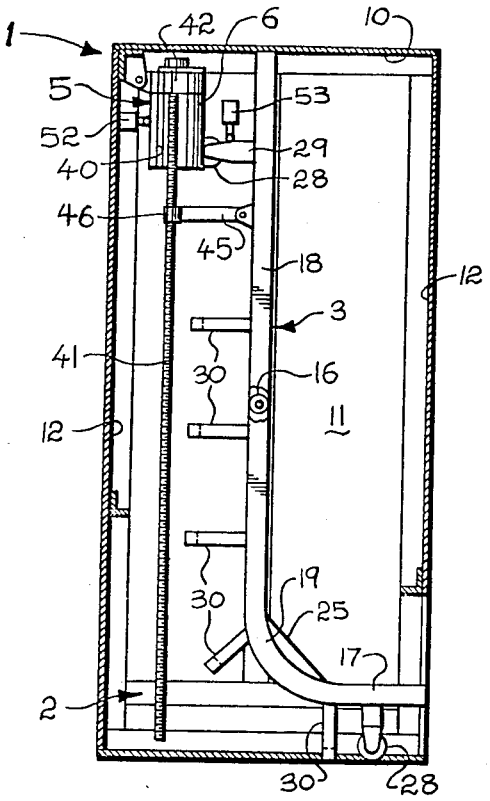
FIG. 3 is a view similar to FIG. 2 and illustrates the bed in a retracted or stored position.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 4:
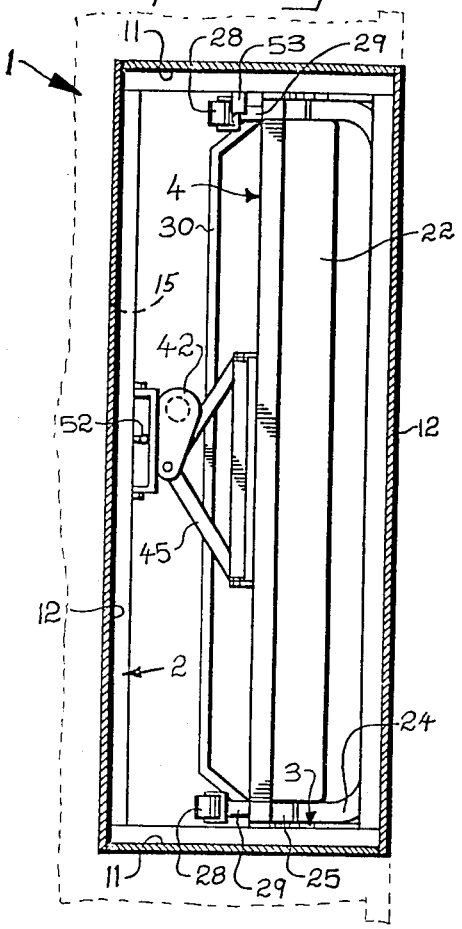
FIG. 4 is a plan view of the bed in the retracted position with a top cover panel of the enclosure removed to illustrate details within the enclosure.
Figure 5:
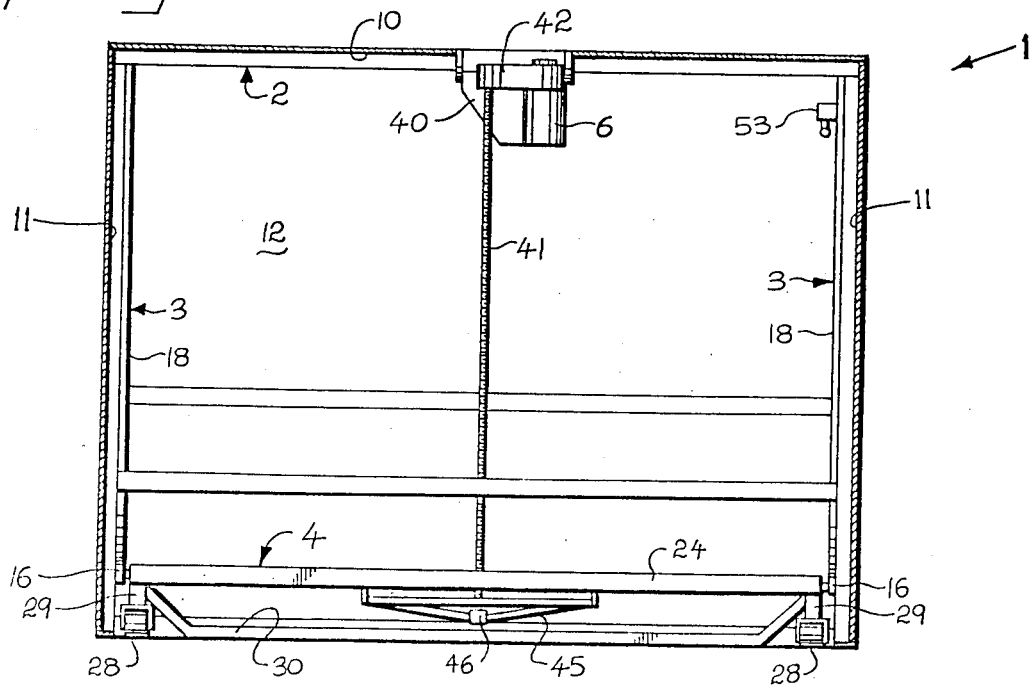
FIG. 5 is a side elevational view of the bed in the extended position with a side cover panel of the enclosure removed.

Referring to the drawings in more detail:

The reference numeral 1 generally designates a retractable bed apparatus according to the present invention. The apparatus 1 generally includes an enclosure frame 2, a pair of mattress frame guide tracks 3, a flexibly hinged mattress frame 4 slidably engaged with the tracks 3, and a motor assembly 5 pivotally connected between the enclosure frame 2 and the mattress frame 4. Operation of a motor 6 of the assembly 5 in one direction causes the extension of the mattress frame 4 from the enclosure frame 2 to a sleeping position as shown in FIGS. 1, 2, and 5 and in the other direction causes the retraction of the mattress frame 4 into the enclosure frame 2 for storage as shown in FIGS. 3 and 4. The mattress frame 4 is preferably oriented for sideways motion during extension from and retraction into the enclosure frame 2.

The illustrated enclosure frame 2 is rectangular in shape and is sized to store the mattress frame 4 completely inside. The frame 2 may be formed from any type of structural members such as steel angle stock as is shown in the figures and assembled in any conventional manner. Other types of metal members, lumber, or other materials could also be employed. The frame 2 is enclosed by a top panel 10, end panels 11, and side panels 12. The enclosure frame 2 together with the panels 10, 11 and 12 define a bed enclosure 14. The enclosure 14 may be built into a room by connecting same to a wall in the room and possibly to the floor as well. Further, the enclosure 14 could be assembled into a recess 15 (FIG. 4) in such a wall or a closet of the required size and shape.

The guide tracks 3 cooperate with the mattress frame 4 to properly position the mattress frame within the enclosure 14. The illustrated tracks 3 are attached inside the ends of the enclosure 14 and are C-shaped in cross section to receive rollers 16 on the sides of the mattress frame 4. Each track member 3 includes a short horizontal segment 17 and a long vertical segment 18 connected by an arcuate or circular segment 19. The configuration of the track segments allow the storage of a major portion of the mattress frame 4 in a vertical orientation.

The mattress frame 4 supports a mattress 22 and sleeping occupants thereon and carries the mattress between the retracted and extended positions of the mattress frame. The illustrated mattress frame 4 includes a pair of C-shaped side members 23 and 24 (FIG. 1) which are interconnected in spaced apart relation by a plurality of frame links 25 hingedly or pivotally interconnected at each end of the mattress frame 4 to form a flexible rectangular frame. A large mesh net type mattress support spring member 27 (FIG. 1) is resiliently attached within side members 23 and 24 and the link members 25 and actually supports the mattress 22. The mattress 22 is attached to the spring member 27, such as by straps or ties (not shown), to prevent the mattress 22 from sliding off the mattress frame 4 during retraction movements.

The mattress frame 4 is supported above the level of the floor by casters 28 on caster legs 29 depending from the corners of the mattress frame 4. In order to prevent the mattress 22 from sagging in the middle when weight is applied thereto, the frame 4 is provided with a plurality of braces or "runners" 30 which depend from the middle portions of the frame 4. The illustrated runners 30 extend between corresponding frame links 25 at opposite ends of the frame 4. It is preferable that the runners 30 do not extend completely to the floor unless a sufficient weight is placed on the mattress to prevent the runners from dragging on the floor and thereby interferring with the deployment motions of the frame 4. The rollers 16 which cooperate with the tracks 3 to guide the mattress frame 4 into the enclosure 14 are positioned at the opposite ends of the mattress frame 4. Preferably, the axles for the rollers 16 are formed by the hinge pins (not shown) which pivotally connect adjacent frame links 25 of the mattress frame 4.

The illustrated mattress frame 4 and the enclosure 14 are sized and shaped to accommodate a standard full size sofa-bed mattress which is slightly smaller than a standard full size mattress for conventional type beds. A so-called full size mattress is capable of sleeping two adult size persons. Alternatively, the enclosure 14 and mattress frame 4 could be adapted to accommodate other size mattresses such as single, queen size, and the like. An shown in FIG. 1, the mattress frame 4 is shaped to orient the head and foot ends 32 and 33 of the mattress 22 adjacent the ends 34 and 35 of the enclosure 14. In such an orientation, the mattress frame 4 moves in a direction perpendicular to the sides 36 and 37 of the mattress 22 during extension and retraction. The illustrated orientation of the mattress 22 results in an enclosure shape which appears less imposing in a room since the height of the enclosure is reduced. In actuality, when the mattress is extended to the sleeping position, the mattress intrudes into the room less than if it were oriented for lengthwise motion.

Referring particularly to FIGS. 6 and 7, the motor assembly 5 includes a motor bracket 40 which is pivotally connected to the enclosure frame 2. The motor 6 is mounted on the bracket 40 and is drivingly engaged with an elongated screw threaded shaft 41. The illustrated motor 6 is a rotary electric motor. The shaft 41 may be connected directly to the shaft of the motor 6 or may be connected indirectly through a gear or belt transmission unit 42. The transmission unit 42 rotatably mounts the shaft 41 on the bracket 40 in addition to transferring drive motion from the motor 6 to the shaft 41.

A nut bracket or arm 45 has one end pivotally connected to the mattress frame 4 and has a nut member 46 formed at an opposite end (see FIGS. 2–5). The nut member 46 is threaded and receives the shaft 41 in threaded engagement therein. Rotation of the motor 6 in one direction causes the nut arm 45 and the mattress frame 4 therewith to move out of the enclosure 14. Rotation of the motor 6 in the opposite direction causes the mattress frame to be drawn into the enclosure 14. As shown in FIG. 2, as the mattress frame end of the nut arm 45 reaches the curved segments 19 of the tracks 3, the motor assembly 5 pivots to follow the mattress frame therearound.

The mattress frame 4 may be extended completely or retracted completely by the operation of appropriate switches 48 on a control panel 49 (FIG. 1). The motion of the mattress frame 4 must be limited to prevent the nut member 46 from slipping off the end of the shaft 41 during extension and to prevent damage to the components of the bed 1 during retraction. In the illustrated bed 1, an extension limit switch 52 and a retraction limit switch 53 are provided. The extension limit switch 52 is positioned on the enclosure frame 2 for contact by the motor bracket 40. The illustrated extension limit switch 52 is a normally open switch which is normally kept in a closed state by contact with the motor bracket 40. The switch 52 is positioned and adjusted such that when operation of the motor 6 has extended the mattress frame to the limit of its desired travel, the motor bracket 40 is moved out of contact with the switch 52, thus breaking the connection for electrical power to the motor 6. The retraction limit switch 53, on the other hand, is a normally closed switch which is mounted on the enclosure frame 2. The switch 53 is opened during retraction of the mattress frame 4 when one of the caster legs 29 contacts same to thereby break the motor circuit. The limit switches 52 and 53 are preferably interconnected with the operation switches 48 and the motor 6 in such a way that when one of the limit switches is operated, only the switch 48 controlling the opposite motion is operative. Alternatively, other types of electrical components could be employed for the control and operation of the bed 1.

Summarizing operation of the retractable bed 1: the extension switch 48 is operated to activate the motor 6 thereby rotating the screw shaft 41. The nut arm 45 is urged away from the motor 6 and the mattress frame 4 therewith. The hinged frame links 25 of the mattress frame 4 flex to follow the curvature of the tracks. When the nut mattress frame side member 23 reaches the curved segments 19 of the tracks 3, the motor assembly 5 pivots to allow the shaft 41 to follow the mattress frame 4 around the curved segments 19. The mattress frame 4 is supported on the floor by casters 28 on caster legs 29. When the mattress frame 4 is fully extended, the motor assembly bracket 40 is pivoted out of contact with the extension limit switch 52 thus halting operation of the motor 6. Weight or occupants on the mattress 22 in the extended position are further supported by runners 30 extending along the mattress frame 4. For storage of the mattress frame 4 within the enclosure 14, the retraction switch 48 is operated, and the process is reversed. The mattress frame 4 may be retracted until one of the caster legs 29 contacts the retraction limit switch 53 whereupon the motor circuit is broken.

It is to be understood that while certain forms of the present invention have been illustrated and described herein, it is not to be limited to the specific forms or arrangement of parts described and shown.

What is claimed and desired to be secured by Letters Patent is as follows:

1. A retractable bed apparatus comprising:

(a) enclosure frame means;

(b) mattress frame guide means positioned within said enclosure frame means;

(c) a flexible mattress frame engaged with said guide means, having a retracted position wherein said mattress frame is received completely within said enclosure frame means, and having a sleeping position wherein said mattress frame is extended from said enclosure frame means;

(d) a mattress affixed to said mattress frame;

(e) a motor bracket pivotally connected to said enclosure frame means;

(f) a rotary motor mounted on said bracket;

(g) an elongated threaded shaft extending from said bracket and drivingly engaged with said motor;

(h) nut means pivotally connected to said mattress frame and in threaded engagement with said shaft; and (i) motor control means connecting said motor to a source of power to selectively rotate said shaft to displace said mattress frame to thereby effect the substantially complete extension of said mattress frame from said enclosure frame means and the retraction of said mattress frame into said enclosure frame means.

2. An apparatus as set forth in claim 1 wherein:

(a) said enclosure frame means is a self-standing framework; and (b) said framework is enclosed by side, end, and top panels.

3. An apparatus as set forth in claim 1 wherein:

(a) said enclosure frame means is positioned in a recess in a building wall.

4. An apparatus as set forth in claim 1 wherein said mattress frame guide means includes:

(a) short left and right horizontal straight guide track segments;

(b) elongated left and right vertical straight guide track segments;

(c) left and right arcuate guide track segments connecting said horizontal track segments respectively with said vertical track segments; and (d) said mattress frame being slidably engaged with said track segments.

5. An apparatus as set forth in claim 1 wherein said mattress frame includes:

(a) a plurality of hingedly interconnected mattress frame sections; and (b) roller means connected with said mattress frame sections and engaging said mattress frame guide means.

6. An apparatus as set forth in claim 1 wherein said mattress frame includes:

(a) floor engaging means to support said mattress frame on a floor in said sleeping position.

7. An apparatus as set forth in claim 1 wherein said mattress frame includes:

(a) a plurality of floor engaging runners extending from said mattress frame to support said mattress frame on a floor in said sleeping position.

8. An apparatus as set forth in claim 1 wherein said mattress frame includes:

(a) a plurality of casters extending from said mattress frame to rollably support said mattress frame on a floor.

9. An apparatus as set forth in claim 1 wherein:

(a) said mattress frame has opposite head and foot ends and opposite lateral sides; and (b) said mattress frame is oriented to be displaced in a direction perpendicular to said sides upon extension and retraction.

10. An apparatus as set forth in claim 1 wherein said nut means includes:

(a) a nut arm having a first end and an opposite second end, said first end being pivotally connected to said mattress frame; and (b) a threaded nut member formed through said second end to receive said shaft in threaded engagement therein.

11. A retractable bed apparatus comprising:

(a) enclosure frame means;

(b) left and right guide tracks; each track including a short horizontal segment connected to an elongated vertical segment by an arcuate segment;

(c) a flexible mattress frame engaged with said tracks, said mattress frame having a retracted position wherein said mattress frame is received completely within said enclosure frame means and a sleeping position wherein said mattress frame is extended from said enclosure frame means;

(d) a mattress affixed to said mattress frame;

(e) a motor bracket pivotally connected to said enclosure frame means;

(f) a rotary motor mounted on said bracket;

(g) an elongated threaded shaft extending from said bracket and drivingly engaged with said motor;

(h) a nut arm having a first end and an opposite second end; said first end being pivotally connected to said mattress frame and said second end having a threaded nut member formed thereon to receive said shaft in threaded engagement therein;

(i) motor control means connecting said motor to a source of power to selectively rotate said shaft to displace said mattress frame along said tracks to thereby effect the substantially complete extension of said mattress frame from said enclosure frame means and the retraction of said mattress frame into said enclosure frame means;

(j) said mattress frame having opposite head and foot ends and opposite lateral sides; and (k) said mattress frame being oriented to be displaced in a direction perpendicular to said sides upon extension and retraction.

12. An apparatus as set forth in claim 11 wherein:

(a) said enclosure frame means is positioned in a recess in a building wall.

13. An apparatus as set forth in claim 11 wherein said mattress frame includes:

(a) a plurality of hingedly interconnected mattress frame sections; and (b) roller means connected with said mattress frame sections and engaging said tracks.

14. An apparatus as set forth in claim 11 wherein said mattress frame includes:

(a) a purality of floor engaging runners extending from said mattress frame to support said mattress frame on a floor in said sleeping position.

15. An apparatus as set forth in claim 11 wherein said mattress frame includes:

(a) a plurality of casters extending from said mattress frame to rollably support said mattress frame on a floor.

* * * * *